United States Patent [19]

Jow

[11] Patent Number: 5,006,048

[45] Date of Patent: Apr. 9, 1991

[54] ELECTRICALLY-OPERATED GEAR ROTOR PUMP

[75] Inventor: Wen-Yuh Jow, Taichung, Taiwan

[73] Assignee: Mingyen Electronics Industry Co., Ltd., Taichung Hsien, Taiwan

[21] Appl. No.: 409,306

[22] Filed: Sep. 19, 1989

[51] Int. Cl.[5] ..... F04B 17/00

[52] U.S. Cl. ..... 417/410; 418/182; 417/366

[58] Field of Search ..... 418/182; 417/410, 366

[56] References Cited

U.S. PATENT DOCUMENTS

| | | | |
|---|---|---|---|
| 2,056,936 | 10/1936 | Hayward | 417/410 |
| 2,060,209 | 11/1936 | Heckert | 418/182 |
| 2,192,588 | 3/1940 | Heckert | 418/182 |
| 2,619,040 | 11/1952 | Maisch | 418/182 |
| 4,500,270 | 2/1985 | Tuckey | 418/166 |

*Primary Examiner*—A. Michael Chambers
*Attorney, Agent, or Firm*—Karl W. Flocks

[57] ABSTRACT

The present disclosure is related to an improved electrically-operated gear rotor pump mainly adapted for automobile fuel injection system; a dc motor in driving connection with the pump is housed together with the pump in a unitary housing. The driving shaft of the dc motor is in coupling engagement with the gear rotor pump by means of a floating coupling device having H-shaped longitudinal cross section. The terminal end of the dc motor shaft is defined in a rectangular form so that it can be properly fitted in the correspondingly shaped groove at one end of the coupling device. The other end of the coupling device is provided with a pair of symmetric semi-circular arms which are in registry with the identically shaped grooves axially extended through the wall of the inner rotor of the gear rotor pump with a fixed shaft, which is secured to the inlet end portion of the pump by interference fit with the inner rotor rotatably mounted thereon, located therebetween. Thereby, no precise axial alignment between the driving shaft of the dc motor and the fixed shaft of the gear rotor pump is necessary, and the precision machining of the related elements can be less critically required with the production cost thereof effectively reduced. In addition, the operation noise of the pump can be greatly improved, and the pump life be enhanced at the same time.

1 Claim, 5 Drawing Sheets

ELECTRICALLY-OPERATED GEAR ROTOR PUMP

BACKGROUND OF THE INVENTION

1. Field of the Invention

The present invention relates to an improved electric dc motor operated gear rotor pump mainly adapted for automobile fuel injection system, and more particularly to a floating coupling device adapted for use in connection of the driving shaft of a dc motor to an inner rotor of a gear rotor pump which is rotatably operated on a fixed shaft. The coupling device according to the present invention is made of either plastics or metals. As a result of the independent, unsupporting relation between the driving shaft of the dc motor and the fixed shaft of the inner rotor, the axial alignment of the above identified two shafts in assembly is not necessarily required, i.e., excessive precision in machining can be avoided, resulting in the reduction of production cost. However, the present invention can perform as satisfactorily as those previous pumps with even less noise.

2. Description of the Prior Art

There have been many types of fuel pumps designed to supply fuel to internal combustion engines of automobiles, such as cam-operated diaphragm pumps and positive displacement vane type pumps. However, another well known gear rotor type pump has been widely adopted in the newly developed fuel injection system for auto gasoline engines popularly employed in gas-saving cars recently manufactured.

Generally speaking, a vane type pump does not have the problem of axial alignment in assembly, but it produces more noise than a gear rotor type pump which requires axial alignment. The advantage of the latter is that less noise is produced in operation.

Tuckey's U.S. Pat. No. 4,500,270 disclosed a fuel pump of gear rotor type operated by a specially modified dc motor which has a cylindrical drive projection 42 at one end with slender projecting fingers 44 circumferentially spaced around projection 42. Those projecting fingers must be fitted into a number of axial deep holes 155 spaced on the inner gear around a circular periphery thereof. Thus, the dc motor can accordingly drive the gear rotor pump to work by moving the inner gear rotatably against an outer gear so to pump fuel from a remotely located tank to a combustion engine.

Although, the Tuckey's U.S. Pat. No. 270' can work normally well, there are still a number of disadvantages in view of production cost and precision machining of the elements and the assembly speed.

The dc motor of Tuckey's, 270' patent adopts a modified cylindrical drive projection having slender projecting fingers. The structure thereof is different from common dc motor of the prior arts; therefore, the production cost unavoidably is increased. Besides, the fitting of the plurality of slender projecting fingers into the axially disposed deep holes requires releative precision in the alignment therebetween.

To solve the above cited problems the present inventor has worked out an improved floating coupling device which is disposed between a dc motor and a gear rotor pump with one end in detachable engagement with the driving shaft of the motor and the other end also in detachable engagement with the inner rotor of the gear rotor pump; thereby, axial alignment is not required in assembly and the operation noise can be also reduced.

SUMMARY OF THE INVENTION

The primary object of the present invention is to provide a floating coupling device adapted for connecting the driving shaft of a dc motor and the inner rotor of a gear rotor type pump mainly adapted for use in fuel injection system of automobile; the floating coupling device of the present invention is made of either plastics or metals, so that the coupling of the driving shaft of the dc motor and the inner rotor of the pump can be effected with ease and without too much consideration of precise axial alignment therebetween. Thus, the precision requirements in production of the components can be less critical to make the assembly work smoothly; and the cost of production and pump operation noise of the pump system can be effectively reduced.

To better illustrate the structure, operation modes and features of the present invention, a number of drawings are given in company with a detailed description of the preferred embodiment, in which;

DETAILED DESCRIPTION OF THE PREFERRED EMBODIMENT

Figure 1:
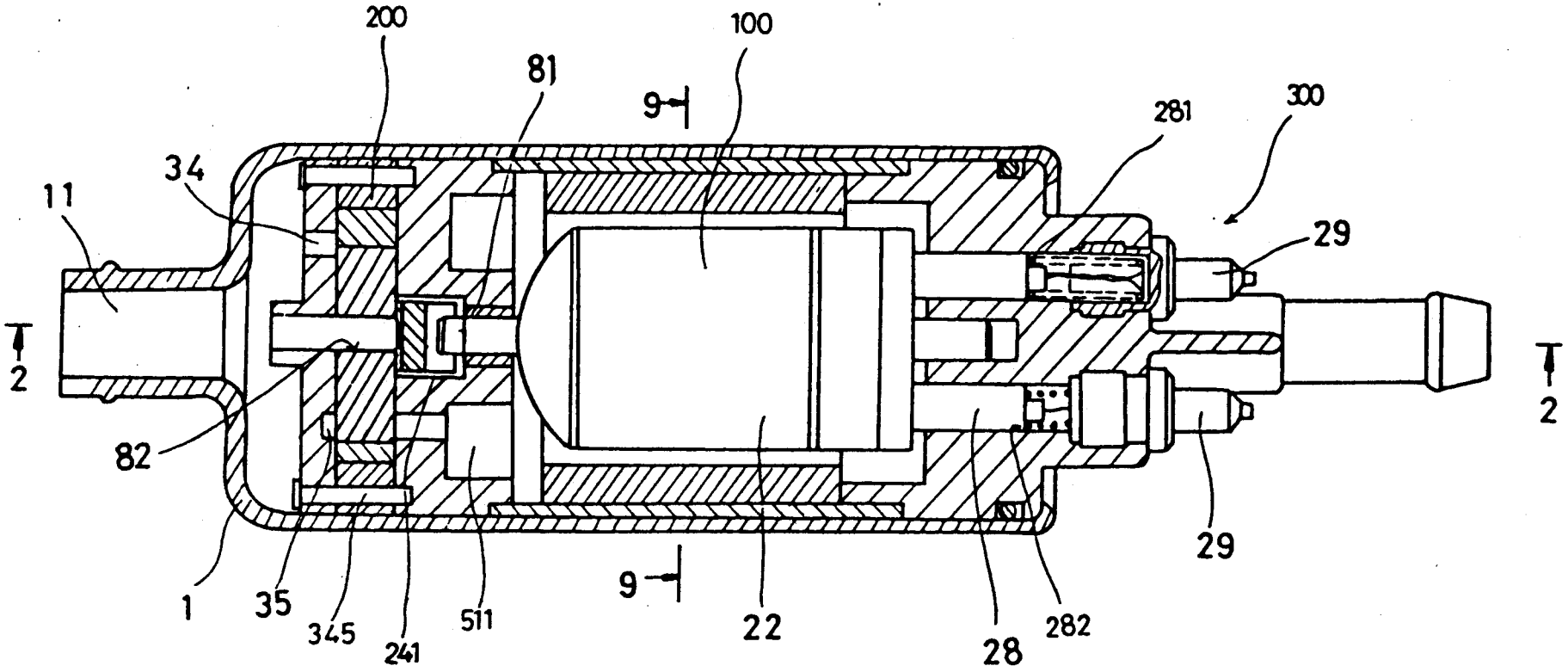
FIG. 1 is a longitudinal section of a pump assembly of the present invention.
Figure 2:
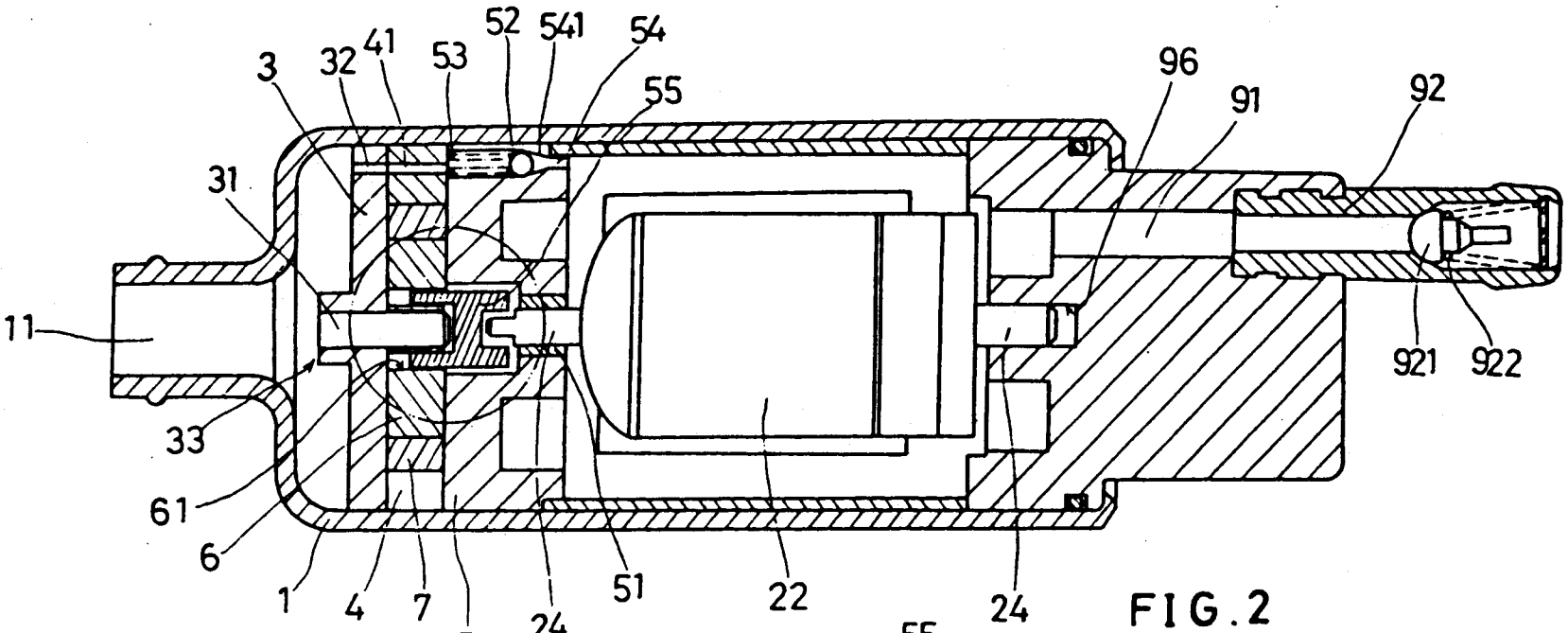
FIG. 2 is a longitudinal section of the pump taken along the line 2—2 in FIG. 1.
Figure 2A:
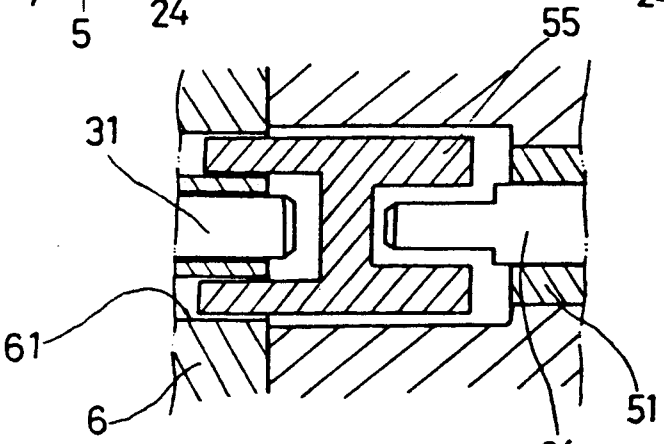
FIG. 2A is an enlarged diagram showing the floating coupling device circled in FIG. 2.

FIGS. 1, 2 are the sectional views of the present fuel pump equipped with a gear type rotor, which mainly comprises a cylindrical casing 1 and a gear rotor pump 200, and a small size dc motor 100 of permanent magnet type and a fuel outlet unit 300 made by plastic injection molding, and etc. Fuel is first fed through a fuel inlet tube 11 extended out of the casing 1, then via the inlet end portion 3 and into the operation area of the gear rotor unit consisting of an inter cam ring 4, an inner rotor 6 and an outer rotor 7. The pressurized fuel is led through the fuel outlet end portion 5 to a chamber where the rotary armature 22 locates, and then to the fuel outlet tube 92 through check valves 921, biased by a spring 922 and out of the pump system.

The driving shaft 24 of the dc motor is made to have a rectangular terminal end 241 extending through the bushing 51 which is mounted on the fuel outlet end portion 5, and into a bore 55 in communication with the bushing 51 but having a larger diameter. Then, the rectangular terminal end 241 is fitted in registry with a correspondingly shaped groove 81 at the solid end of a floating coupling device 8 according to the present invention. The groove 81 can have a larger axial and radial tolerence, the axial tolerence at least 1–2 mm, and the radial tolerence about 1 mm, when engaged with the rectangular terminal end 241. In practical operation, the floating coupling device 8 is able to rotate in the bore 55 of the fuel outlet end portion 5; the tolerence of the coupling with the bore 55 can reach 100–400 μm.

The other end of the coupling device 8 is provided with a pair of spaced semi-circular arms 81 extended in the axial direction. On the external wall of the inner rotor 6 are disposed a pair of correspondingly shaped through grooves 61 so as to permit the semi-circular arms 81 to engage therewith in assembly. In the same manner, the grooves can have larger axial and radial tolerence in fitting. The driving shaft 24 is thus able to urge the inner rotor 6 to rotate by means of the floating coupling device 8 of the present invention. The large tolerence in fitting comes from the independence of the driving shaft 24 and the floating coupling device 8 and the fixed shaft 31.

Figure 3:
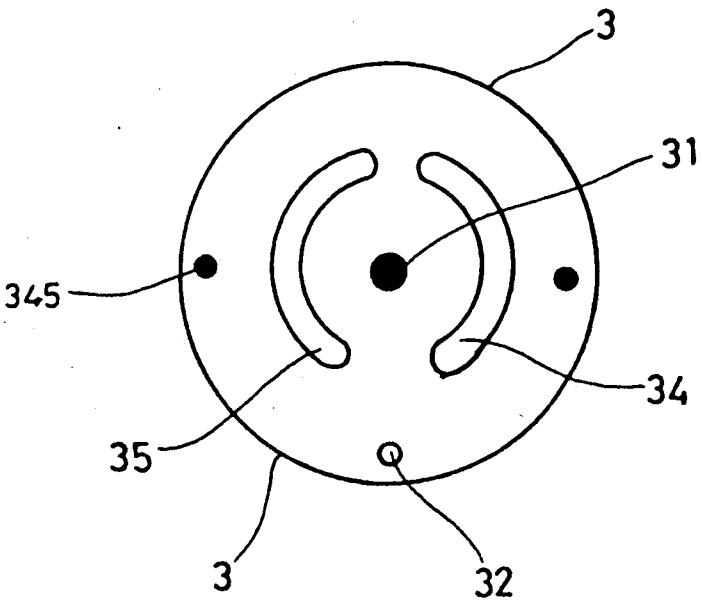
FIG. 3 is a diagram showing the fuel inlet end portion (end view of the gear rotor pump)
Figure 5:
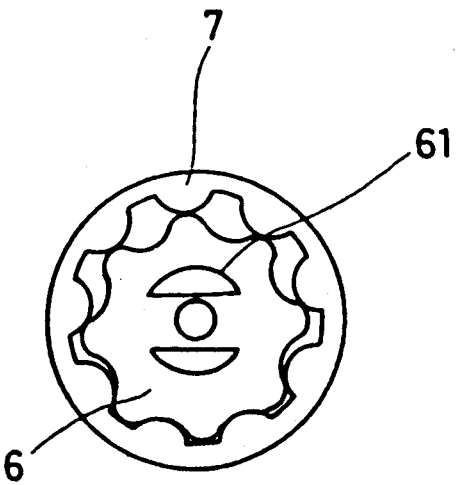
FIG. 5 is a plan view of the gear rotor unit of the present invention.

The fixed shaft 31 on which the inner rotor 6 rotatably mounts is tightly secured in place with respect to the fuel inlet end portion 3 by interference fit so as to provide the inner rotor 6 a stable rotation center. Thereby, the driving shaft 24 of the dc motor, the coupling device 8 and the fixed shaft 31 on which the inner rotor 6 rotates can be readily jointed in alignment with each other axially. As a result of the adoption of the present floating coupling device 8, no axial alignement among the shafts is required; i.e., 0.2–0.3 mm offset is allowable, and the inner rotor 6 can still operate stably with less noise and the frictional abrasion between the inner rotor and outer rotor effectively reduced. On the inlet end portion 3 is disposed an arcuate fuel inlet port 34, and at the symmetric position thereon is disposed a pressure balance groove 35 for reduction of the frictional abrasion between the gear rotors 6, 7 and the inlet end portion 3, as shown in FIG. 3. At the center of the inlet end portion 3 is disposed a shaft fixing hole 33 in which the fixed shaft 31 is secured in place by interference fit.

Figure 4:
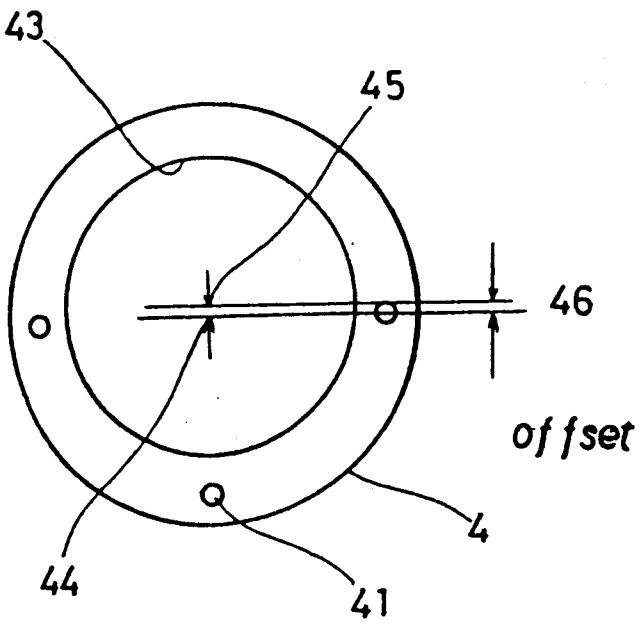
FIG. 4 is a plan view showing the inner cam ring of the gear rotor unit invention.

As shown in FIG. 4, an inter cam ring 4 disposed between the inlet end portion 3 and the outlet end portion 5 is provided with a central hole 43 in which the outer rotor 7 can rotatably move. The rotation center 44 of the inner rotor 6 deviates from the center 45 of the inter cam ring 4 by an offset 46, so that the space between the inner rotor 6 and the outer rotor 7 can be continuously varied as the two rotors are in relative rotational movement, causing the fuel to flow and pump out without interruption.

Figure 6:
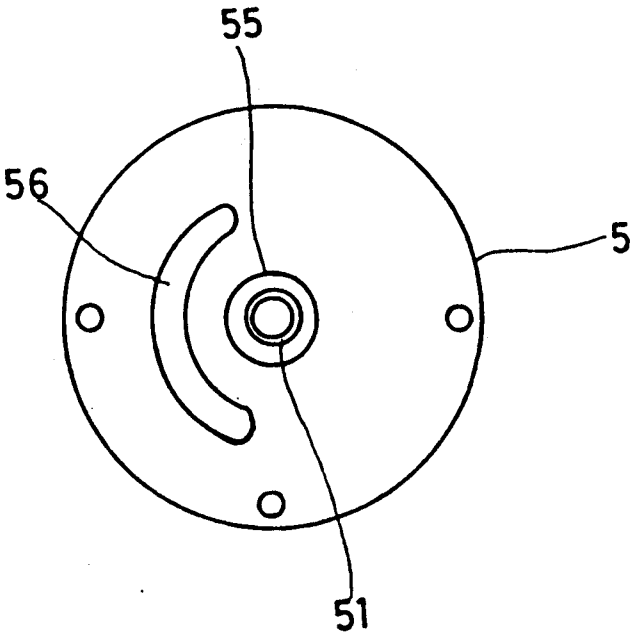
FIG. 6 is a plan view showing the fuel outlet end portion (end view of the gear rotor pump)
Figure 7:
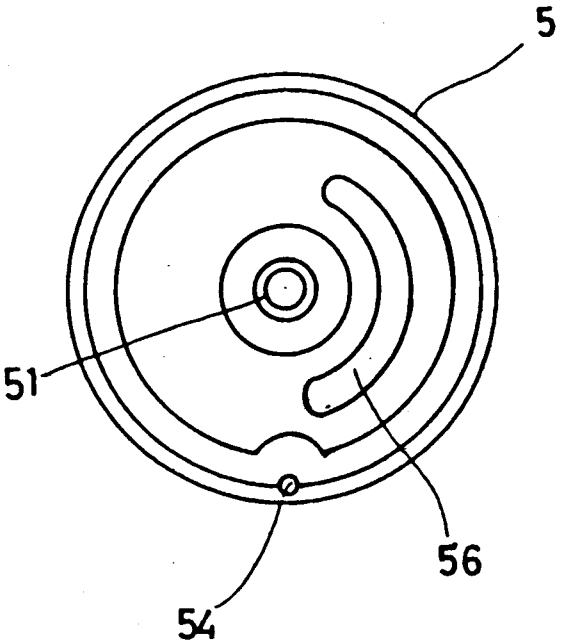
FIG. 7 is a plan view of the fuel outlet end portion, taken from the other end of FIG. 6.
Figure 9:
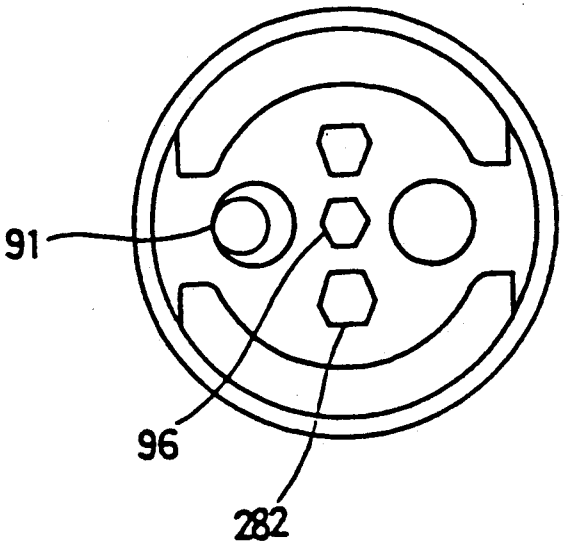
FIG. 9 is a lateral section taken along the line 9—9 in FIG. 1.
Figure 8:
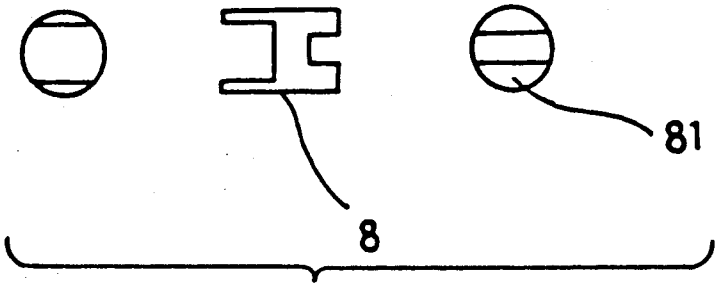
FIG. 8 is a diagram showing the 3-side views of the floating coupling device of the present invention.

The outlet end portion 5 is provided with an arcuate outlet port 56, as shown in FIGS. 6, 7; and at the center of the same is disposed a tubular opening consisting of two consecutive sections of different diameters, with a shaft bore 55 in the larger section and with a bushing 51 having a smaller diameter than the bore 55 located next to it in the axial direction for use as a bearing of the driving shaft 24 of the dc motor. Adjacent to the external periphery of the bushing 51 is a peripherally disposed arcuate groove 511 part of which is in communication with the gear rotor pump by way of the outlet port 56. A through hole 54 is disposed above the arcuate groove 511, the front end of the through hole 54 is defined in a cone shape with a valve ball 52 and a spring 53 located therein to form a relief valve. The spring 53 is in urging abutment with the valve ball 52 at one end and in contact with the wall of the inter cam ring 4 at the other. When the pressure in the pressurized fuel builds up too high, fuel will push the valve open and flow through the passage 41 and 32 on the inter cam ring 4 and the inlet end portion 3 to the inlet tube 11, forming a recycle. This kind of arrangement has the merit that all the valve ball 52 and spring 53 are disposed in the outlet end portion 5 with the inter cam ring 4 closing the end thereof without use of extral element to secure the spring in place.

The inlet end portion 3, the inter cam ring 4 and the outlet end portion 5, the inner and outer rotors 6, 7 and the floating coupling device 8 are integrally joined together by means of rivets 345, as shown in FIG. 1, forming a totally independent system of the dc driving motor 100. Thus, the assembly of the present invention becomes relatively convenient.

The fuel outlet assembly 300 made by plastic injection modling has a pair of holes 282 for the disposition of carbon brushes, and the front end of each hole 282 is disposed an electrode rod 29 through which electric power can be supplied. A hole 96 having a hexagonal cross section is employed to fix the other support end of the dc motor 24. A check valve consisting of a valve element 921, a spring 922 is used to prevent the pressure of the fuel in the conduit between the engine and the pump system to reduce when the pump is stopped to operate.

I claim:

1. An improved dc motor operated pump of gear rotor type adapted for automobile fuel injection system comprising a cylindrical casing having an extended fuel inlet tube;

an inlet end portion having an arcuate fuel inlet port disposed thereon being located right next to said fuel inlet tube in said casing with a shaft fixing hole being disposed at the center thereof in which a central fixed shaft is secured in place by way of interference fit;

a gear rotor unit having an inner rotor rotatably on said fixed shaft in engagement with said central shaft fixing hole; and an inner cam ring; and an outer rotor disposed within said inner cam ring and means to allow rotating of said outer rotor together with said inner rotor; said gear rotor unit being disposed adjacent said inlet end portion and in abutment therewith at one side thereof and in abutment with an outlet end portion at the other side thereof;

said outlet end portion having an arcuate fuel inlet port in communication with the gear rotor unit, and a central tubular opening having two sections of different diameters; said outlet end portion being located next to said gear rotor unit; a bearing means being secured in place in the section having smaller diameter of said tubular opening at the end away from said gear rotor unit;

a dc motor having an extended driving shaft, the terminal end thereof being defined in rectangular form; said driving shaft being rotatable with said bearing;

a pair of semi-circular through grooves symmetrically disposed on the wall of said inner rotor with said central shaft fixing hole located therebetween; and a floating coupling means having an H-shaped cross section; one end of said coupling means being defined in solid form with a rectangular groove disposed thereon and being rotatably located in the central tubular opening in the section having a larger diameter of said outlet end portion so that a rectangular terminal end of said driving shaft of the dc motor can be in engagement therewith; the other end of said coupling device being provided with a pair of semi-circular arms which are in registry with said semi-circular through grooves on said inner rotor so that the floating coupling device can operatively join the inner rotor rotatably with respect to said fixed shaft and the driving shaft of said dc motor together;

a fuel outlet assembly having a pair of holes for the disposition of carbon brushes of said dc motor, and at the front end of each said hole is disposed an electrode rod; a hexagon-shaped hole being disposed at the center thereof for the location of a support end of said dc motor at the opposite end of said driving shaft;

a fuel outlet passage having a valve means disposed at the frontmost end thereof, wherein the improvement consists in the adoption of said floating coupling device which is used to couple the driving shaft of said dc motor and said inner rotor which is rotatably mounted on said fixed shaft so as to permit the power of said dc motor to transmit to said gear rotor pump without the consideration of axial alignment.

* * * * *